US010329702B2

(12) United States Patent
Hirota et al.

(10) Patent No.: US 10,329,702 B2
(45) Date of Patent: Jun. 25, 2019

(54) DRUM WASHING MACHINE

(71) Applicants: HAIER ASIA CO., LTD., Tokyo (JP); QINGDAO HAIER WASHING MACHINE CO., LTD., Qingdao, Shandong (CN)

(72) Inventors: Hiromi Hirota, Tokyo (JP); Harumi Takeuchi, Tokyo (JP); Hiroyuki Tanaka, Tokyo (JP); Takahiro Tsuji, Tokyo (JP); Shigeharu Nakamoto, Tokyo (JP)

(73) Assignees: HAIER ASIA CO., LTD., Tokyo (JP); QINGDAO HAIER WASHING MACHINE CO., LTD., Qingdao (CN)

( * ) Notice: Subject to any disclaimer, the term of this patent is extended or adjusted under 35 U.S.C. 154(b) by 157 days.

(21) Appl. No.: 15/508,091

(22) PCT Filed: Sep. 2, 2015

(86) PCT No.: PCT/CN2015/088808
§ 371 (c)(1),
(2) Date: Mar. 1, 2017

(87) PCT Pub. No.: WO2016/034115
PCT Pub. Date: Mar. 10, 2016

(65) Prior Publication Data

US 2017/0284007 A1 Oct. 5, 2017

(30) Foreign Application Priority Data

Sep. 2, 2014 (JP) ..... 2014-177623

(51) Int. Cl.
*D06F 37/06* (2006.01)
*D06F 25/00* (2006.01)
(Continued)

(52) U.S. Cl.
CPC ..... *D06F 37/06* (2013.01); *D06F 23/02* (2013.01); *D06F 25/00* (2013.01); *D06F 37/22* (2013.01);
(Continued)

(58) Field of Classification Search
CPC ..... D06F 23/02; D06F 25/00; D06F 37/06; D06F 37/22; D06F 37/304; D06F 37/40; D06F 39/02
See application file for complete search history.

(56) References Cited

U.S. PATENT DOCUMENTS 2,637,186 A * 5/1953 Douglas ..... D06F 23/025 68/23.4
2,637,189 A * 5/1953 Douglas ..... D06F 23/02 210/211
(Continued)

FOREIGN PATENT DOCUMENTS

CN 1749471 3/2006
CN 1888191 1/2007
(Continued)

OTHER PUBLICATIONS

International Application No. PCT/CN2015/088808, International Search Report, dated Dec. 16, 2015.

*Primary Examiner* — Joseph L. Perrin
(74) *Attorney, Agent, or Firm* — Greenberg Traurig, LLP

(57) ABSTRACT

A drum washing machine is provided. The drum washing machine includes: an outer tank arranged in a housing; a drum, which is arranged in the outer tank and capable of rotating about a horizontal shaft H; a rotating body, which is arranged at a rear part of the drum, a surface of the rotating body being provided with a projection; and a driving part, configured to drive the drum and the rotating body to coaxially rotate at different rotating speeds. The drum has a baffle arranged on an inner circumferential surface of the
(Continued)

drum, which is used as a moving unit configured to move the washings in the drum towards the rotating body. The baffle has gathering surfaces for gathering the washings through a rotation of the drum. The gathering surfaces are inclined so that the side of the rotating body is lagged in a rotation direction of the drum.

7 Claims, 13 Drawing Sheets

(51) Int. Cl.

| | |
|---|---|
| ***D06F 23/02*** | (2006.01) |
| ***D06F 37/22*** | (2006.01) |
| ***D06F 37/30*** | (2006.01) |
| ***D06F 37/40*** | (2006.01) |
| ***D06F 39/02*** | (2006.01) |

(52) U.S. Cl.
CPC ..... *D06F 37/304* (2013.01); *D06F 37/40* (2013.01); *D06F 39/02* (2013.01)

(56) References Cited

U.S. PATENT DOCUMENTS

| | | | | | |
|---|---|---|---|---|---|
| 2,717,135 | A * | 9/1955 | Douglas | D06F 37/22 | 248/560 |
| 4,941,333 | A * | 7/1990 | Blessing | D06F 23/025 | 68/142 |
| 5,115,651 | A * | 5/1992 | Nukaga | D06F 25/00 | 210/363 |
| 5,289,703 | A * | 3/1994 | Hiyashi | D06F 37/04 | 68/142 |
| 7,441,422 | B2 * | 10/2008 | Choi | D06F 25/00 | 366/225 |
| 7,555,924 | B2 * | 7/2009 | Fumagalli | D06F 37/04 | 68/145 |
| 2002/0029594 | A1 * | 3/2002 | Monteiro | D06F 21/04 | 68/140 |
| 2004/0035155 | A1 * | 2/2004 | Yoon | D06F 23/02 | 68/145 |
| 2004/0163429 | A1 * | 8/2004 | Lim | D06F 37/40 | 68/140 |
| 2013/0111676 | A1 * | 5/2013 | Jun | H02K 21/12 | 8/137 |
| 2013/0118212 | A1 * | 5/2013 | Jun | H02K 21/12 | 68/140 |
| 2014/0366283 | A1 * | 12/2014 | Jun | D06F 37/304 | 8/137 |
| 2015/0176172 | A1 * | 6/2015 | Kim | D06F 37/04 | 68/140 |
| 2015/0225885 | A1 * | 8/2015 | Kim | D06F 37/04 | 68/140 |

FOREIGN PATENT DOCUMENTS

| | | | |
|---|---|---|---|
| JP | 02271896 | | 11/1990 |
| JP | 0351080 | | 3/1991 |
| JP | 03051080 | A * | 3/1991 |
| JP | 2006158488 | | 6/2006 |
| JP | 2007111431 | | 5/2007 |
| JP | 2009247720 | | 10/2009 |
| KR | 1020050119263 | | 12/2005 |

* cited by examiner

DRUM WASHING MACHINE

The present application is a national stage application submitted under 35 USC § 371 for International Patent Application No. PCT/CN2015/088808, entitled "DRUM WASHING MACHINE", filed Sep. 2, 2015, which claims the priority date of Japanese Patent Application No. 2014-177623, filed Sep. 2, 2014.

TECHNICAL FIELD

The present disclosure relates to a drum washing machine, which not only can be continuously operated from washing to drying, but also can carry out washing without drying.

BACKGROUND

In the past, a drum washing machine rotates a horizontal shaft drum in an outer tank storing water at a bottom thereof, thus washings are lifted up and dropped down by baffles arranged in the drum, and the washings are thrown to an inner circumferential surface of the drum to be washed (with reference to patent literature 1).

In this way, in a structure of stirring the washings by the baffles, the washings are difficult to twine or rub against each other. Therefore, compared with an automatic washing machine in which the washings are washed through rotation of a pulsator in a washing and spin-drying tank, the drum washing machine has a small mechanical force acted on the washings, and the detergency is reduced.

Therefore, the drum washing machine may adopt the following structure: a rotating body, the surface of which is provided with a projection, is arranged at a rear surface of the drum, and the drum and the rotating body can rotate at different rotating speeds during washing and rinsing. The washing performance can be improved by rubbing and stirring the washings through the rotating body.

EXISTING TECHNICAL LITERATURE

Patent Literature

Patent Literature 1: Japanese Laid-Open Patent Publication No. 2013-240577

SUMMARY

Problems to be Solved

Under a condition of adopting the above structure, when the washings are not near the rotating body, the washings fail to contact the rotating body and a washing effect brought by the rotating body cannot be thoroughly obtained.

Therefore, the present disclosure aims to provide a drum washing machine capable of thoroughly obtaining the washing effect brought by the rotating body.

Solution for Solving the Problems

A drum washing machine in a main embodiment of the present disclosure includes: an outer tank arranged in a housing; a drum, which is arranged in an outer tank and capable of rotating about a horizontal shaft; a rotating body, which is arranged at a rear part of the drum, and a surface of the rotating body being provided with a projection for contacting washings; and a driving part, configured to drive the drum and the rotating body to coaxially rotate at different rotating speeds. Herein, the drum has a moving unit configured to move the washings in the drum towards the rotating body.

With the above structure, since the washings can be positioned near the rotating body, the washings are easy to contact the rotating body and a washing effect brought by the rotating body can be thoroughly given to the washings.

In the drum washing machine of the present embodiment, a structure that the moving unit includes a baffle can be adopted, in which the baffle is arranged on an inner circumferential surface of the drum, and has gathering surfaces for gathering the washings through a rotation of the drum, the gathering surfaces are inclined so that the side of the rotating body is lagged in a rotation direction of the drum.

Through the above structure, since the gathering surfaces are inclined so that the side of the rotating body is lagged in the rotation direction of the drum, the side of the rotating body becomes lower in a period of gathering the washings. As a result, the washings can be moved towards the rotating body along the gathering surfaces when being gathered by the gathering surfaces.

In this way, through the above structure, the washings can be moved to approach the rotating body while being rolled through the baffles, so that the washings can be easily contacted the rotating body, and the washings can be sufficiently imparted with a washing effect brought by the rotating body.

Further, under a condition of adopting the above structure, the baffle can be configured into a structure with two gathering surfaces which respectively correspond to a right rotation and left rotation of the drum.

If such a structure is adopted, the washings can approach the rotating body regardless of whether the drum rotates in a right direction or a left direction.

In the drum washing machine of the present embodiment, a structure that the moving units include the baffle can be adopted, in which the baffle is arranged on the inner circumferential surface of the drum, and can rotate about a rotating shaft arranged on an end part opposite to the side of the rotating body, so that the baffle can incline to two sides from being parallel to the horizontal shaft.

Through the above structure, if the drum respectively rotates to the right and the left, the baffle is inclined due to weight of the washings when the washings are folded, so that the side of the rotating body becomes lower. Thus, the washings are moved towards the side of the rotating body along inclination of the baffle.

In this way, through the above structure, the washings can be moved to approach the rotating body while being rolled through the baffle, so that the washings can be easily brought into contacting the rotating body, and the washings can be sufficiently imparted with the washing effect brought by the rotating body. Further, the washings can approach the rotating body regardless of whether the drum rotates in the right direction or the left direction.

In the drum washing machine of the present embodiment, the moving unit can be configured as a structure including the inner circumferential surface of the drum, which is inclines so that a diameter of the inner circumferential surface of the drum becomes larger when approaching the rear part of the drum.

Through the above structure, when the washings rolled along with the rotation of the drum fall onto the inner circumferential surface of the drum, the washings are moved towards the side of the rotating body in the rear along the downward inclination of the inner circumferential surface.

In this way, through the above structure, the washings can approach the rotating body through the inclination of the inner circumferential surface of the drum, so that the washings can be easily brought into contacting the rotating body, and the washings can be sufficiently imparted with the washing effect brought by the rotating body.

Effects of the Disclosure

Through the present disclosure, a drum washing machine, which is capable of thoroughly obtaining a washing effect brought by a rotating body, can be provided.

Effects and significances of the present disclosure are further clarified by embodiments shown below. However, the following embodiments are just an illustration when the present disclosure is implemented, and the present disclosure is not limited by any content described in the following embodiments.

DETAILED DESCRIPTION

Hereinafter, a drum washing machine without a drying function as an embodiment of the drum washing machine of the present disclosure is described by referring to drawings.

Figure 1:
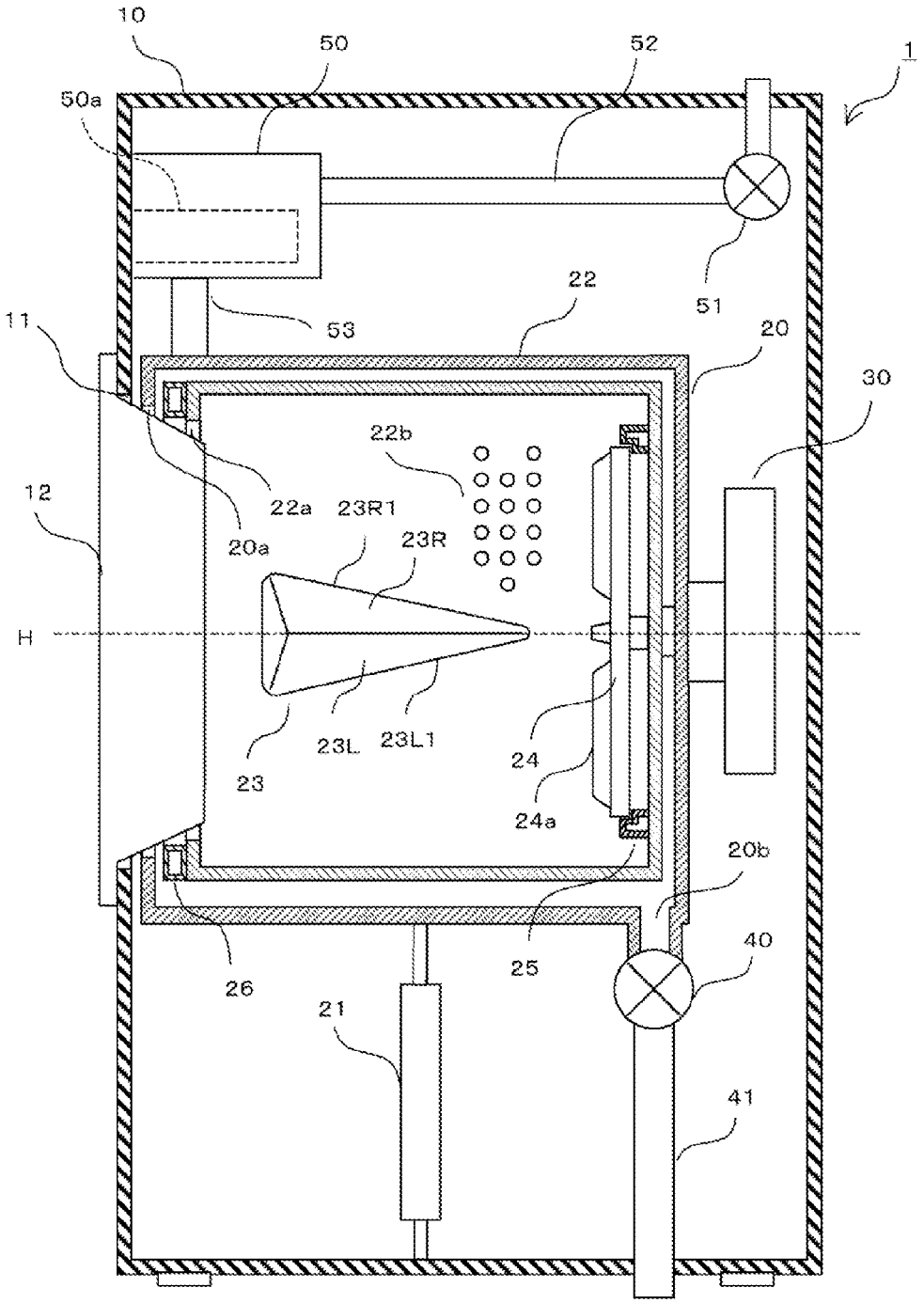
FIG. 1 is a side sectional view illustrating a structure of a drum washing machine according to embodiments.

FIG. 1 is a side sectional view illustrating a structure of a drum washing machine 1.

The drum washing machine 1 includes a housing 10 forming an appearance. A throwing inlet 11 for the washings is formed in a front surface of the housing 10. The throwing inlet 11 is covered by a door 12 which is freely opened and closed.

An outer tank 20 is elastically supported by a plurality of vibration dampers 21 in the housing 10. A horizontal shaft drum 22 is rotatably provided in the outer tank 20. The drum 22 rotates about a horizontal shaft H. An opening part 20*a* in the front surface of the outer tank 20 and an opening part 22*a* in the front surface of the drum 22 are opposite to the throwing inlet 11, and are closed by the door 12, together with the throwing inlet 11. A plurality of spin-drying holes 22*b* are substantially formed throughout a surface of a circumferential wall of the drum 22. Further, three baffles 23 are arranged in the circumferential direction at roughly equal intervals on the inner circumferential surface of the drum 22. FIG. 1 only shows one of the baffles 23. The baffles 23 are not limited to three as long as at least one baffle is arranged in the drum 22. A detailed structure of the baffles 23 is described later.

A rotating body 24 is rotatablely provided at the rear of the drum 22. The rotating body 24 has a roughly disc shape and coaxially rotates with the drum 22. A plurality of projections 24*a* are formed on the surface of the rotating body 24. Further, an annular retainer 25 which encircles the rotating body 24 is arranged at the rear part of the drum 22. The retainer 25 prevents the washings from being clamped into a gap generated between the rotating body 24 and the drum 22.

An annular fluid balancer 26 is arranged on the front surface of the drum 22. The fluid balancer 26 inhibits a rotation of the drum 22 generated in spin-drying.

A driving part 30 for generating a torque for driving the drum 22 and the rotating body 24 is arranged behind the outer tank 20. In a washing process and a rinsing process, the driving part 30 enables the drum 22 and the rotating body 24 to rotate at different rotating speeds in a same direction. Specifically, the driving part 30 enables the drum 22 to rotate at a rotating speed through which centrifugal force applied to the washings in the drum 22 is smaller than gravity, and enables the rotating body 24 to rotate at a rotating speed greater than that of the drum 22. On the other hand, in a spin-drying process, the driving part 30 enables the drum 22 and the rotating body 24 to integrally rotate at a rotating speed through which the centrifugal force applied to the washings in the drum 22 is much greater than the gravity. A detailed structure of the driving part 30 is described later.

A drainage outlet part 20*b* is formed at the bottom of the outer tank 20. The drainage outlet part 20*b* is provided with a drainage valve 40. The drainage valve 40 is connected with a drainage hose 41. When the drainage valve 40 is opened, water stored in the outer tank 20 is discharged out of the machine through the drainage hose 41.

A detergent box 50 is arranged on the upper part of the front in the housing 10. A detergent container 50*a* containing detergents is held in the detergent box 50 in a manner of being withdrawn from the front freely. The detergent box 50 is connected with, through a water feeding hose 52, a water feeding valve 51 disposed on the upper part at the rear in the housing 10. In addition, the detergent box 50 is connected with the upper part of the outer tank 20 through a water injection pipe 53. When the water feeding valve 51 is opened, water from a faucet is supplied into the outer tank 20 by virtue of the water feeding hose 52, the detergent box 50 and the water injection pipe 53. At this moment, the detergents contained in the detergent container 50*a* are supplied into the outer tank 20 along with a water flow.

Next, the structure of the driving part 30 is described in detail.

Figure 2:
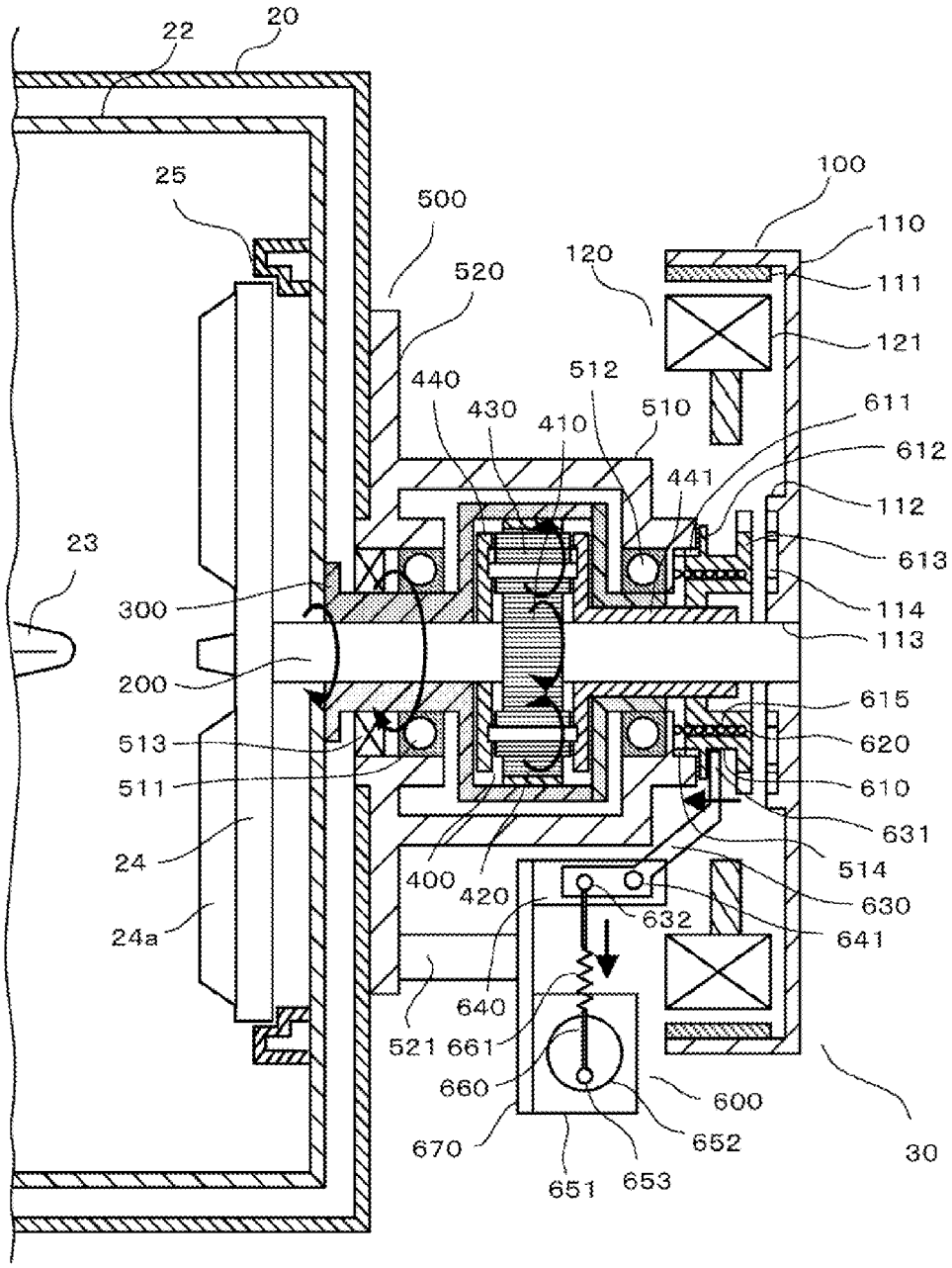
FIG. 2 is a sectional view illustrating a structure of a driving part according to embodiments.
Figure 3:
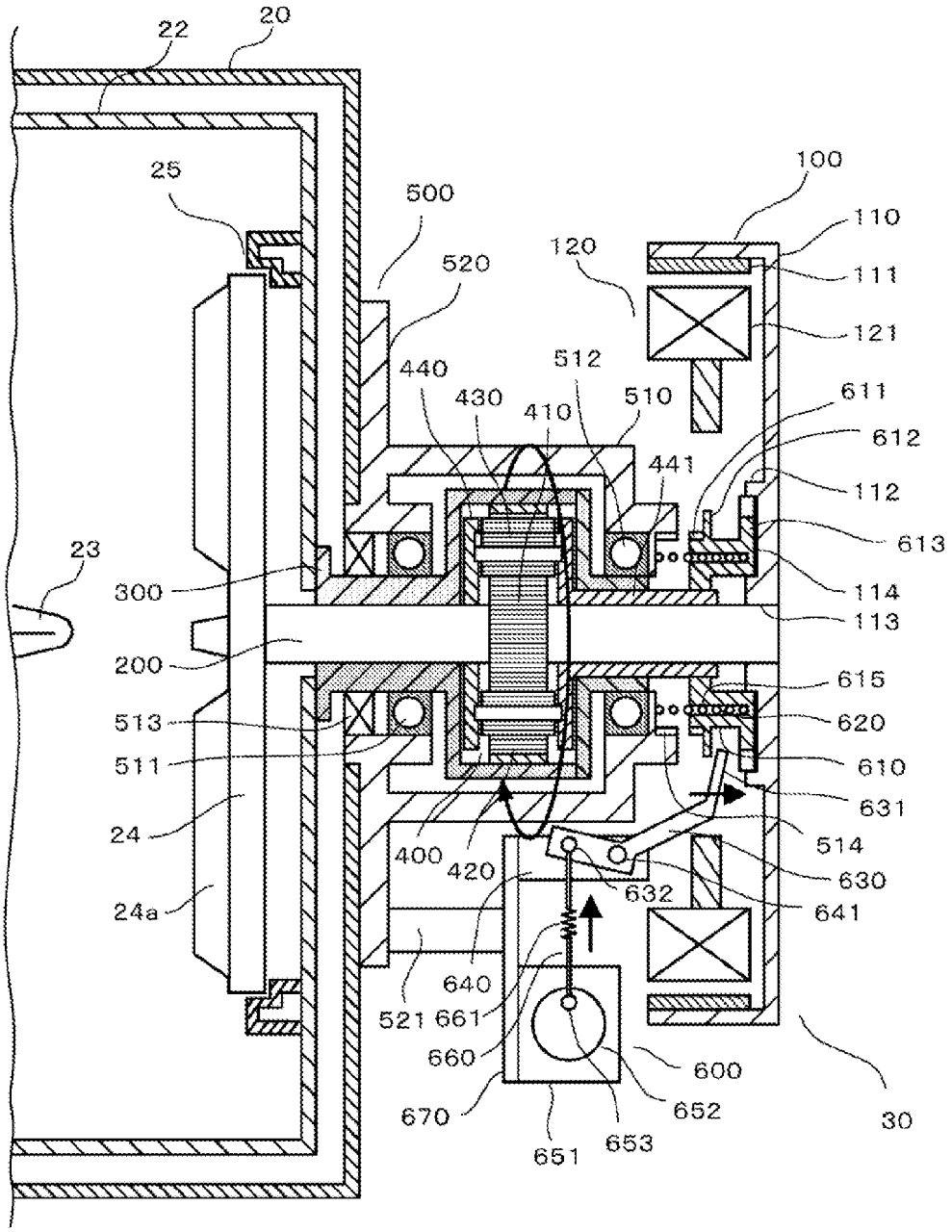
FIG. 3 is a sectional view illustrating a structure of a driving part according to embodiments.
Figure 4:
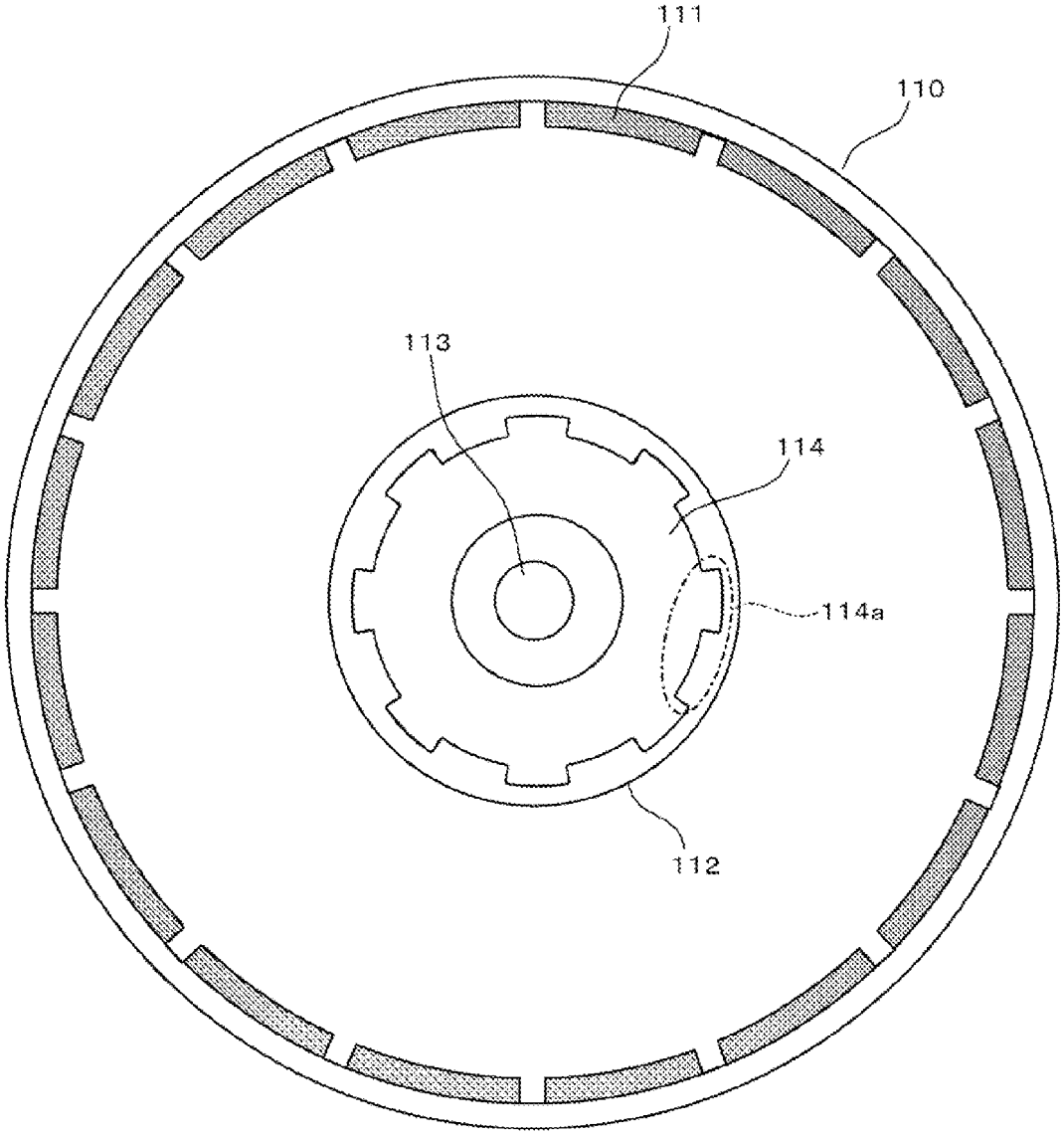
FIG. 4 is a rotor front view illustrating a structure of a rotor of a driving motor according to embodiments.
Figure 5:
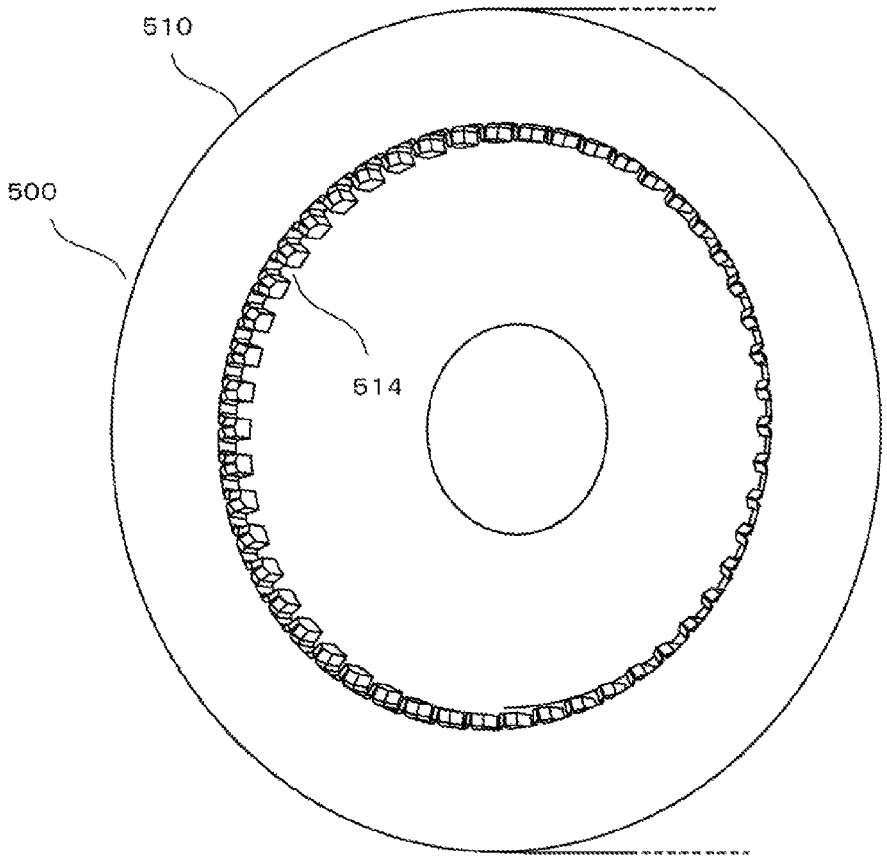
FIG. 5 is an enlarged perspective view illustrating a rear part of a bearing unit formed with a rack according to embodiments.
Figure 6:
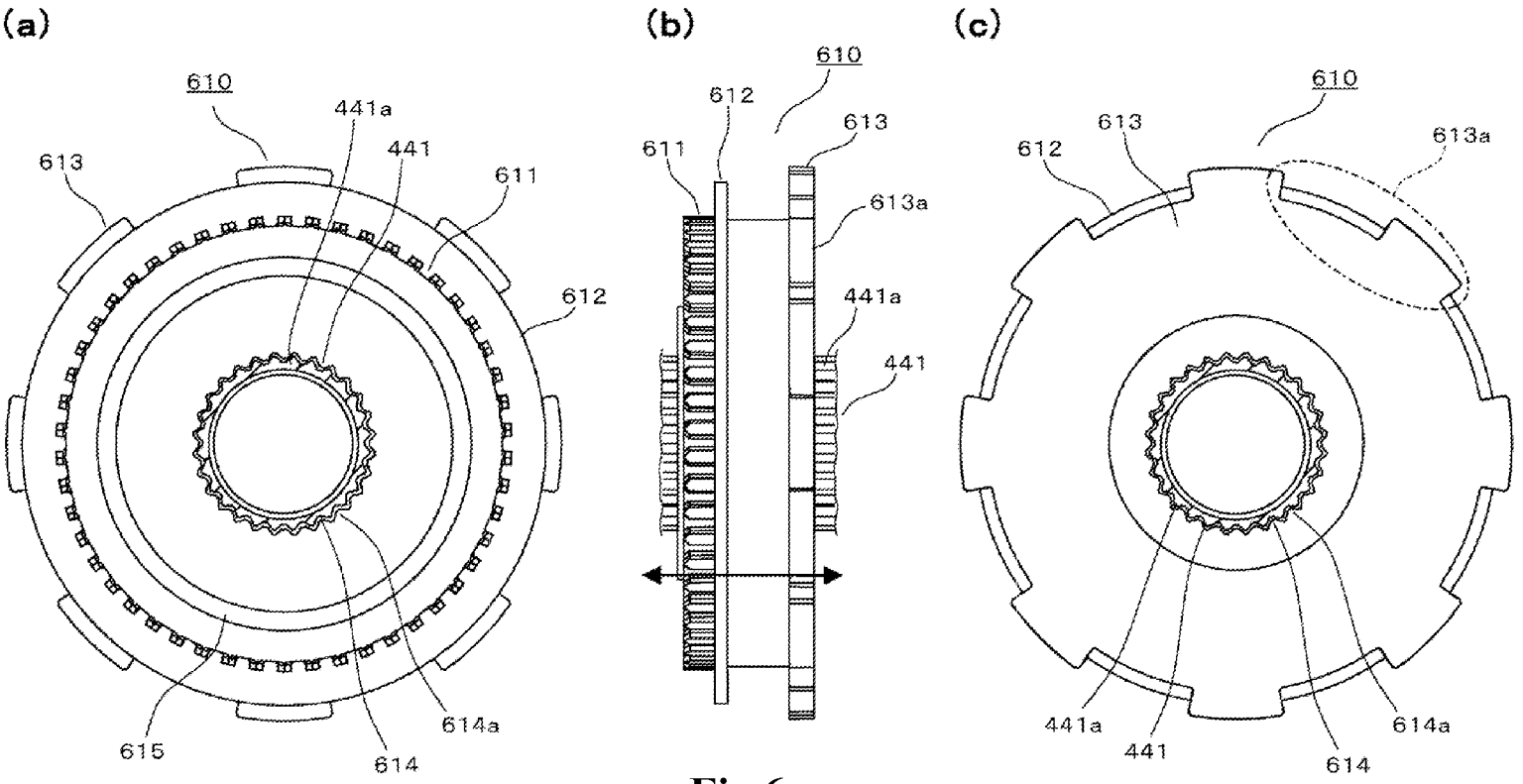
FIG. 6's (*a*)~(*c*) are diagrams illustrating a structure of a clutch body of a clutch mechanism part according to embodiments.

FIG. 2 and FIG. 3 are sectional views illustrating the structure of the driving part 30. FIG. 2 shows a state in which a driving form of the driving part 30 is switched to a biaxial driving form. FIG. 3 shows a state in which the driving form of the driving part 30 is switched to a uniaxial driving form. FIG. 4 is a front view of a rotor 110 of a driving motor 100, in which a structure of the rotor 110 is illustrated. FIG. 5 is an enlarged perspective diagram of a rear part of a bearing unit 500 formed with a rack 514. FIGS. 6(*a*)~(*c*) are diagrams illustrating a structure of a clutch body 610 of a clutch mechanism part 600, i.e., a front view, a right view and a back view of the clutch body 610.

The driving part 30 includes: the driving motor 100, a wing shaft 200, a drum shaft 300, a planetary gear mechanism 400, the bearing unit 500 and the clutch mechanism part 600. The driving motor 100 is configured to generate a torque for driving the rotating body 24 and the drum 22. The wing shaft 200 rotates by utilizing the torque of the driving motor 100, and transmits the rotation thereof to the rotating body 24. The planetary gear mechanism 400 is configured to decelerate the rotation of the wing shaft 200, namely rotation of the rotor 110 of the driving motor 100, and transmit the rotation to the drum shaft 300. The drum shaft 300 coaxially rotates with the wing shaft 200 at a rotating speed being decelerated through the planetary gear mechanism 400, and transmits the rotation to the drum 22. The wing shaft 200 and the drum shaft 300 are rotatablely supported by the bearing unit 500. The clutch mechanism part 600 is configured to switch the driving part 30 between the biaxial driving form and the uniaxial driving form. The biaxial driving form is a form in which the rotating body 24, namely the wing shaft 200, is enabled to rotate at a rotating speed the same as that of the driving motor 100, and the drum 22, namely the drum shaft 300, is enabled to rotate at the rotating speed being decelerated through the planetary gear mechanism 400. The uniaxial driving form is a form in which the rotating body 24 and the drum 22 (namely the wing shaft 200, the drum shaft 300) as well as the planetary gear mechanism 400 integrally rotate at a rotating speed the same as that of the driving motor 100.

The driving motor 100 is an external rotor type direct current (DC) brushless motor, including the rotor 110 and a stator 120. The rotor 110 is formed as a cylinder with a bottom, and is provided with permanent magnets 111 on the inner circumferential surface thereof throughout the circumference. As shown in FIG. 4, a circular shaft sleeve part 112 is formed at the central part of the rotor 110. The shaft sleeve part 112 is formed with a shaft sleeve hole 113 for fixing the wing shaft 200, and an annular engaged recess 114 is formed at a periphery of the shaft sleeve hole 113. Uneven parts 114*a* are arranged at a periphery of the engaged recess 114 throughout the periphery.

The stator 120 is provided with a coil 121 at a periphery thereof. The rotor 110 rotates when driving current is supplied from a motor driving part not shown to the coil 121 of the stator 120.

The drum shaft 300 has a hollow shape in which is provided with the wing shaft 200 and the planetary gear mechanism 400. The central part of the drum shaft 300 protrudes outward to form a receiving part for the planetary gear mechanism 400.

The planetary gear mechanism 400 includes: a sun gear 410; an annular internal gear 420 surrounding the sun gear 410; a plurality of groups of planetary gears 430 between the sun gear 410 and the internal gear 420; and a planetary gear carrier 440 through which the planetary gears 430 are rotatablely retained.

The sun gear 410 is fixed on the wing shaft 200, and the internal gear 420 is fixed on the drum shaft 300. A group of planetary gears 430 includes a first gear and a second gear which are engaged with each other and reversely rotate. The planetary gear carrier 440 includes a planet carrier shaft 441 extending backward. The planet carrier shaft 441 and the drum shaft 300 are coaxial, and the planet carrier shaft 441 is hollow so as to be inserted by the wing shaft 200.

The rear end of the wing shaft 200 protrudes backward from the planet carrier shaft 441 and is fixed at the shaft sleeve hole 113 in the rotor 110.

A cylindrical bearing part 510 is arranged at the central part of the bearing unit 500. In the bearing part 510, a rolling bearing 511 and a rolling bearing 512 are arranged at the front part and rear part, and a mechanical seal 513 is arranged at the front end part. The peripheral surface of the drum shaft 300 is supported by the rolling bearings 511 and 512 so that the drum shaft 300 smoothly rotates inside the bearing part 510. In addition, water is prevented from intruding between the bearing part 510 and the drum shaft 300 through the mechanical seal 513. As shown in FIG. 5, racks 514 are formed on an inner surface of the rear end part of the bearing part 510 throughout a periphery thereof.

A securing flange part 520 is formed around the bearing part 510 of the bearing unit 500. A mounting protrusion 521 is formed at a lower end of the securing flange part 520.

The bearing unit 500 is fixed on a rear surface of the outer tank 20 through the securing flange part 520 by fastening screws and other securing methods. The wing shaft 200 and the drum shaft 300 enter into the interior of the outer tank 20 in a state that the driving unit 30 is mounted on the outer tank 20. The drum 22 is fixed on the drum shaft 300, and the rotating body 24 is fixed on the wing shaft 200.

The clutch mechanism part 600 includes: the clutch body 610, a clutch spring 620, a clutch lever 630, a lever supporting part 640, a clutch driving apparatus 650, a relaying rod 660 and a mounting plate 670.

As shown in FIGS. 6(*a*)~(*c*), the clutch body 610 has an approximately disc shape. An annular rack 611 is formed on an outer circumferential surface of a front end of the clutch body 610. The rack 611 is formed to be engaged with the rack 514 in the bearing unit 500. In addition, a flange part 612 is formed on a peripheral surface of the clutch body 610, and the flange part 612 is behind the rack 611. Further, an annular engaging flange part 613 is formed at the rear end of the clutch body 610. The engaging flange part 613 has the same shape as that of the engaged recess 114 of the rotor 110, and is provided with uneven parts 613*a* throughout the periphery thereof. When the engaging flange part 613 is inserted into the engaged recess 114, the uneven parts 613*a* and 114*a* are engaged with one another.

The planet carrier shaft 441 is inserted into a shaft hole 614 of the clutch body 610. A rack 614*a* formed on an inner circumferential surface of the shaft hole 614 is engaged with the rack 441*a* formed in an outer circumferential surface of the planet carrier shaft 441. Therefore, the clutch body 610 is in the following state: relative to the planet carrier shaft 441, movement in the front and rear directions is allowed and rotation in the circumferential direction is limited.

An annular receiving groove 615 is formed on an outer side of the shaft hole 614 in the clutch body 610. The clutch spring 620 is received in the receiving groove 615. One end of the clutch spring 620 abuts the rear end of the bearing part 510, and the other end of the clutch spring 620 abuts a bottom surface of the receiving groove 615.

The upper end of the clutch lever 630 is provided with a pressing part 631 which contacts the rear surface of the flange part 612 in the clutch body 610 and pushes the flange part 612 forward. The clutch lever 630 is rotatablely supported by a fulcrum 641 provided in the lever supporting part 640. A mounting shaft 632 is formed at a lower end of the clutch lever 630.

The clutch driving apparatus 650 is arranged below the clutch lever 630. The clutch driving apparatus 650 includes a torque motor 651 and a disc-shaped cam 652 which rotates about a horizontal axis by virtue of a torque from the torque motor 651. A camshaft 653 is arranged on a periphery of the cam 652. A rotating center of the cam 652 is consistent with a center of the mounting shaft 632 of the clutch lever 630 in the front and rear directions.

The relaying rod 660 extends up and down and connects the clutch lever 630 and the cam 652. An upper end of the relaying rod 660 is mounted on the mounting shaft 632 of the clutch lever 630, and a lower end of the relaying rod 660 is mounted on the camshaft 653 of the cam 652. A spring 661 is integrally formed in a middle position of the relaying rod 660 and is an extension spring.

The lever supporting part 640 and the clutch driving apparatus 650 are fixed on the mounting plate 670 by fastening screws and other securing methods. The mounting plate 670 is fixed on a mounting protrusion 521 of the bearing unit 500 by screws.

In the case that the driving form of the driving part 30 is switched from the uniaxial driving form to the biaxial driving form, the torque motor 651 drives the cam 652 to rotate, so that the camshaft 653 is positioned at the lowest part, as shown in FIG. 2. Along with the rotation of the cam 652, the lower end of the clutch lever 630 is pulled downward by the relaying rod 660. The clutch lever 630 rotates forward with respect to the fulcrum 641, and the pressing part 631 pushes the clutch body 610 forward. The clutch body 610 moves forward against an elastic force of the clutch spring 620, and the rack 611 of the clutch body 610 is engaged with the rack 514 of the bearing unit 500.

The rack 611 of the clutch body 610 reaches a position where the rack 611 is engaged with the rack 514 when the camshaft 653 is moved to a specified middle position. Then, the spring 661 of the relaying rod 660 is in a natural length state. Since the clutch body 610 will not moved to a position in front of the engaging position, the spring 661 extends downward when the camshaft 653 is moved from the specified position to the lowest position, as shown in FIG. 2. In this way, since the clutch lever 630 is pulled by the spring 661 to rotate forward, a pressing force is applied to the clutch body 610 positioned at the engaging position by the pressing part 631. Thus, the rack 611 can be tightly engaged with the rack 514.

When the rack 611 is engaged with the rack 514, a rotation of the clutch body 610 relative to the bearing unit 500 in the circumferential direction is limited, that is, the clutch body 610 is in a non-rotatable state, thus the planet carrier shaft 441 of the planetary gear mechanism 400 (namely the planetary gear carrier 440) is fixed to be non-rotatable. In such a state, when the rotor 110 rotates, the wing shaft 200 rotates at a rotating speed equal to that of the rotor 110, and the rotating body 24 connected with the wing shaft 200 also rotates at a rotating speed equal to the rotating speed of the rotor 110. As for the planetary gear mechanism 400, the sun gear 410 rotates along with the rotation of the wing shaft 200. As mentioned above, the planetary gear carrier 440 is in a fixed state, thus the first gear and second gear of the planetary gears 430 rotate in a direction opposite to that of the sun gear 410 and the same direction with that of the sun gear 410 respectively, and the internal gear 420 and the sun gear 410 rotate in the same direction. As a result, the drum shaft 300 fixed on the internal gear 420 rotates at a rotating speed lower than that of the wing shaft 200 in the same direction as that of the wing shaft 200, so that the drum 22 fixed on the drum shaft 300 rotates at a rotating speed lower than that of the rotating body 24 in the same direction as that of the rotating body 24. In other words, the rotating body 24 rotates at a rotating speed greater than that of the drum 22 in the same direction as that of the drum 22.

On the other hand, in the case that the driving form of the driving unit 30 is switched from the biaxial driving form to the uniaxial driving form, the torque motor 651 drives the cam 652 to rotate so that the camshaft 653 is positioned at the uppermost part, as shown in FIG. 3. When the cam 652 rotates to enable the camshaft 653 to move upward, the spring 661 contracts firstly. After the spring 661 returns to the natural length, the relaying rod 660 moves upward along with the movement of the camshaft 653, so that the lower end of the clutch lever 630 is pushed by the relaying rod 660 to move upward. The clutch lever 630 rotates backward about the fulcrum 641, so that the pressing part 631 is separated from the flange part 612 of the clutch body 610. The clutch body 610 moves backward by the elastic force of the clutch spring 620, so that the engaging flange part 613 of the clutch body 610 is engaged with the engaged recess 114 of the rotor 110.

When the engaging flange part 613 is engaged with the engaged recess 114, a rotation of the clutch body 610 relative to the rotor 110 in the circumferential direction is limited, so that the clutch body 610 is capable of rotating with the rotor 110. In such a state, when the rotor 110 rotates, the wing shaft 200 and the clutch body 610 rotate at a rotating speed equal to the rotating speed of the rotor 110. At this moment, as for the planetary gear mechanism 400, the sun gear 410 and the planetary gear carrier 440 rotate at a rotating speed equal to that of the rotor 110. Thus, the internal gear 420 rotates at a rotating speed equal to that of the sun gear 410 and the planetary gear carrier 440, so that the drum shaft 300 fixed on the internal gear 420 rotates at a rotating speed equal to that of the rotor 110. That is, in the driving part 30, the wing shaft 200, the planetary gear mechanism 400 and the drum shaft 300 rotate integrally. Therefore, the drum 22 and the rotating body 24 rotate integrally.

Next, the structure of the baffle 23 is described in detail.

Figure 7:
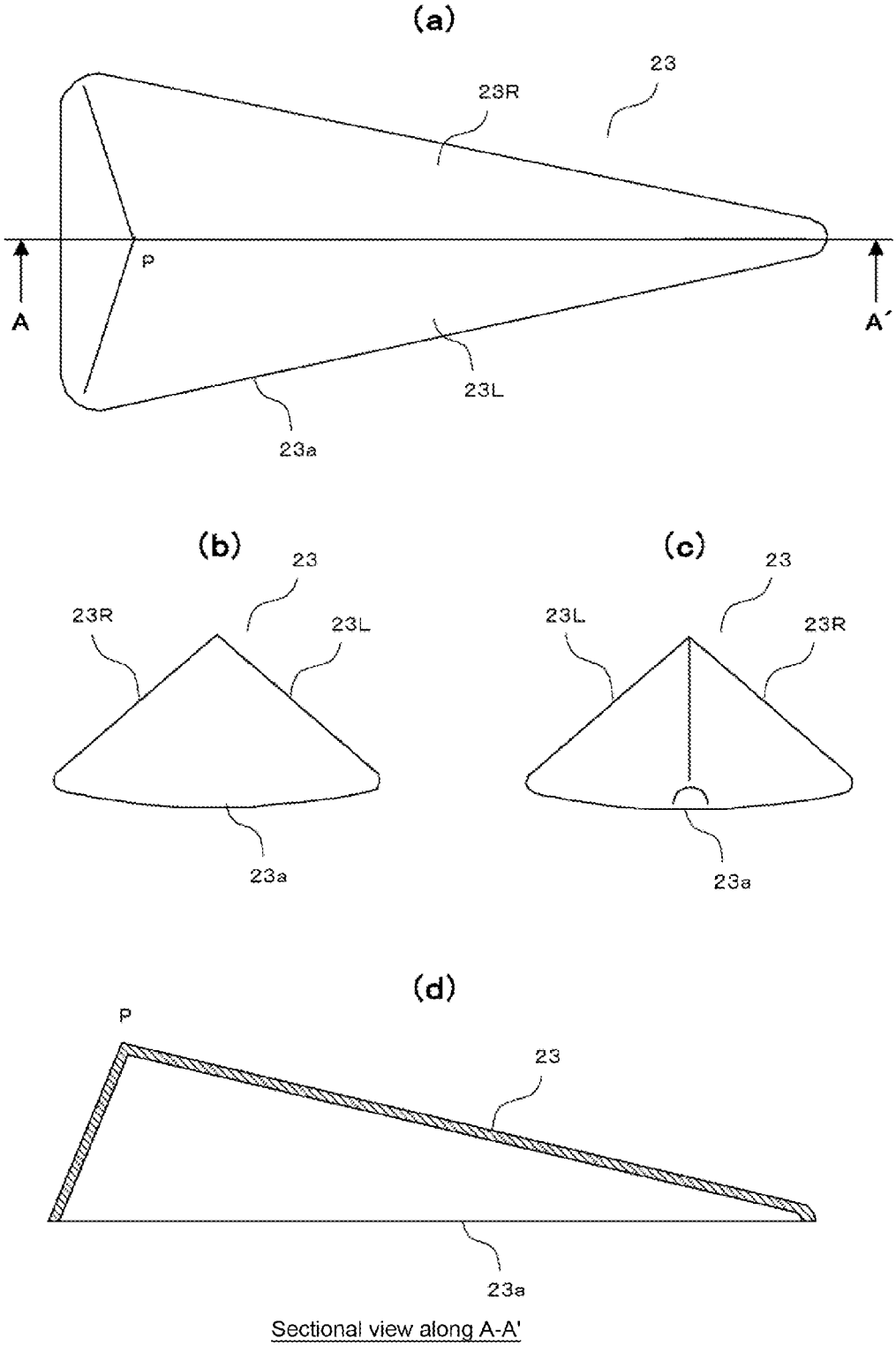
FIG. 7's (*a*)~(*d*) are diagrams illustrating a structure of a baffle according to embodiments.

FIG. 7 is a diagram illustrating the structure of the baffle 23. FIGS. 7(*a*), (*b*) and (*c*) are a top view, a front view and a rear view of the baffle 23 respectively. FIG. 7(*d*) is a sectional view along A-A' in FIG. 7(*a*).

With reference to FIG. 1 and FIG. 7, a bottom surface 23*a* of the baffle 23 is an approximate isosceles triangle, and the baffle 23 is an approximate triangular pyramid in which vertex P opposite to the bottom surface 23*a* is located near a bottom edge on a central line of the isosceles triangle. The baffle 23 is a hollow body of which the bottom surface is opened, and includes an approximate triangular right gathering surface 23R for gathering the washings when the drum 22 rotates to the right and an approximate triangular left gathering surface 23L for gathering the washings when the drum 22 rotates to the left. As shown in FIG. 1, when the baffle 23 is mounted on the inner circumferential surface of the drum 22, an edge 23R1, which is abutted against the inner circumferential surface of the drum 22, of the right gathering surface 23R is inclined rather than being parallel to a horizontal axis H. The right gathering surface 23R per se is inclined so that the side of the rotating body 24 is lagged in the right rotation direction of the drum 22. In addition, an edge 23L1, which is abutted against the inner circumferential surface of the drum 22, of the left gathering surface 23L is inclined rather than being parallel to the horizontal axis H. The left gathering surface 23L per se is inclined so that the side of the rotating body 24 is lagged in the left rotation direction of the drum 22.

The drum washing machine 1 performs a washing operation of various operation modes. A washing process, an intermediate spin-drying process, a rinsing process and a final spin-drying process are sequentially performed in the washing operation. It should be noted that the intermediate spin-drying process and the rinsing process may be performed more than twice sometimes according to the operation mode.

In the washing process and rinsing process, the driving form of the driving part 30 is switched to the biaxial driving form. In the case that the washings in the drum 22 is soaked in water, and the water accumulated in the outer tank 20 does not reach a specified water level of the lower edge of the throwing inlet 11, the driving motor 100 alternately performs right rotation and left rotation. As a result, the drum 22 and the rotating body 24 alternately performs the right rotation and the left rotation with the rotating speed of the rotating body 24 being greater than that of the drum 22. At this time, the drum 22 rotates at a rotating speed so that the centrifugal force exerted on the washings is smaller than the gravity. The washings in the drum 22 are lifted up and down by the baffles 23 (i.e., rolling in the drum 22), and are thrown onto the inner circumferential surface of the drum 22. In addition, at the rear part of the drum 22, the washings contact the projections 24*a* of the rotating body 24 which is rotating, and are rubbed and stirred by the projections 24*a*. Thus, the washings are washed or rinsed.

In this way, not only a mechanical force generated by the rotation of the drum 22 but also an mechanical force generated by the rotating body 24 are exerted on the washings during the washing and rinsing process, thus the improvement of the cleaning performance can be expected. The driving form of the driving part 30 is switched to the uniaxial driving form in the intermediate spin-drying process and the final spin-drying process. The driving motor 100 (that is to say, the drum 22) and the rotating body 24 integrally rotate at a rotating speed so that the centrifugal force acted on the washings in the drum 22 is far larger than the gravity. Due to the action of the centrifugal force, the washings are pressed on the inner circumferential surface of the drum 22 for spin-drying.

In this way, the drum 22 and the rotating body 24 integrally rotate in the spin-drying process, the washings attached to the drum 22 can be well spin-dried without being stirred by the rotating body 24.

Figure 8:
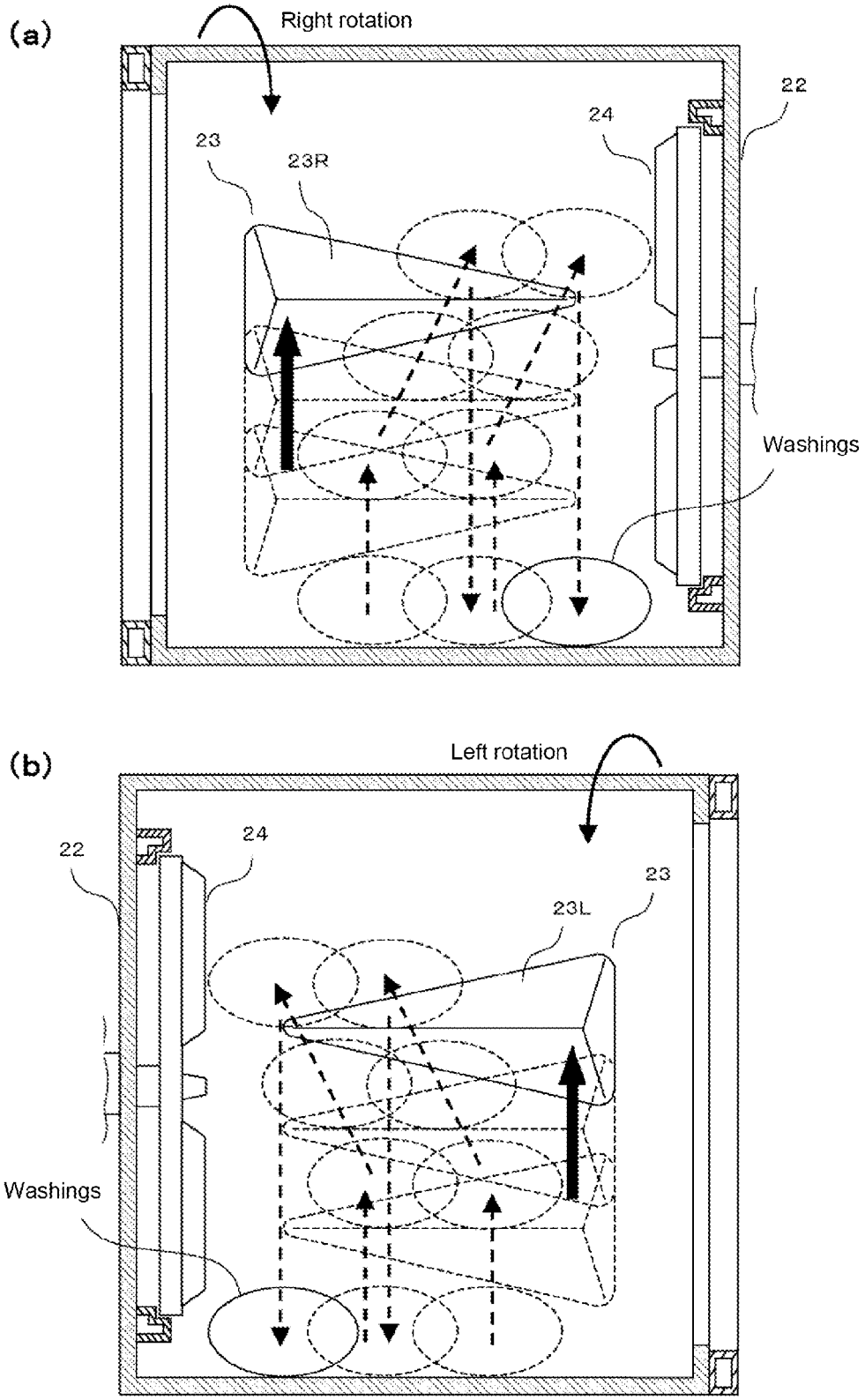
FIG. 8's (*a*)~(*b*) are diagrams schematically illustrating a moving direction of the washings that are rolled through baffles during a washing or rinsing process according to embodiments.

FIG. 8 is a diagram schematically illustrating a tendency of the washings which are rolled through the baffles 23 during the washing or rinsing process. FIG. 8(*a*) schematically illustrates the tendency of the washings when the drum 22 is rotated to the right; and FIG. 8(*b*) schematically illustrates the tendency of the washings when the drum 22 is rotated to the left.

As mentioned above, the right gathering surface 23R is inclined so that the side of the rotating body 24 is lagged in the right rotation direction of the drum 22, thus the side of the rotating body 24 becomes lower in a period of gathering the washings. Therefore, when being gathered by the right gathering surface 23R, the washings move to the side of the rotating body 24 along the right gathering surface 23R. Similarly, the left gathering surface 23L is inclined so that the side of the rotating body 24 is lagged in the left rotation direction of the drum 22, thus the side of the rotating body 24 becomes lower in the period of gathering the washings. As a result, when being gathered by the left gathering surface 23L, the washings are moved to the side of the rotating body 24 along the left gathering surface 23L. In this way, even if the washings are placed at a front side of the drum 22, i.e., a position away from the rotating body 24, the washings are moved to a rear side of the drum 22, i.e., the vicinity of the rotating body 24, in a period of repeatedly rolling the washings through the left rotation and right rotation of the drum 22, as shown in dotted arrows of FIGS. 8(*a*) and (*b*).

In this way, in the present embodiment, the drum 22 has the baffles 23 which constitute a moving unit. The washings can move to the rear part of the drum 22 equipped with the rotating body 24 while being rolled through the baffles 23. Thus, for example, even if a small amount of washings are thrown to the vicinity of the front side of the drum 22, the washings can also be moved towards the side of the rotating body 24 and contact the rotating body 24. Therefore, the washings can be well imparted with the washing effect brought by the rotating body 24 without being affected by the amount of the washings and the like.

Further, in the present embodiment, the moving unit configured to enable the washings to move to the side of the rotating body 24 can be easily realized by considering the shape of the baffle 23. Specifically, the baffle 23 is formed into an approximate triangular pyramid in which the right gathering surface 23R is inclined so that the side of the rotating body 24 is lagged in the right rotation direction of the drum 22, and the left gathering surface 23L is inclined so that the side of the rotating body 24 is lagged in the left rotation direction of the drum 22.

Although embodiments of the present disclosure are described above, the present disclosure is not limited to the above embodiments. In addition, embodiments of the present disclosure may be subjected to various modifications in addition to the description above.

<Modification I>

Figure 9:
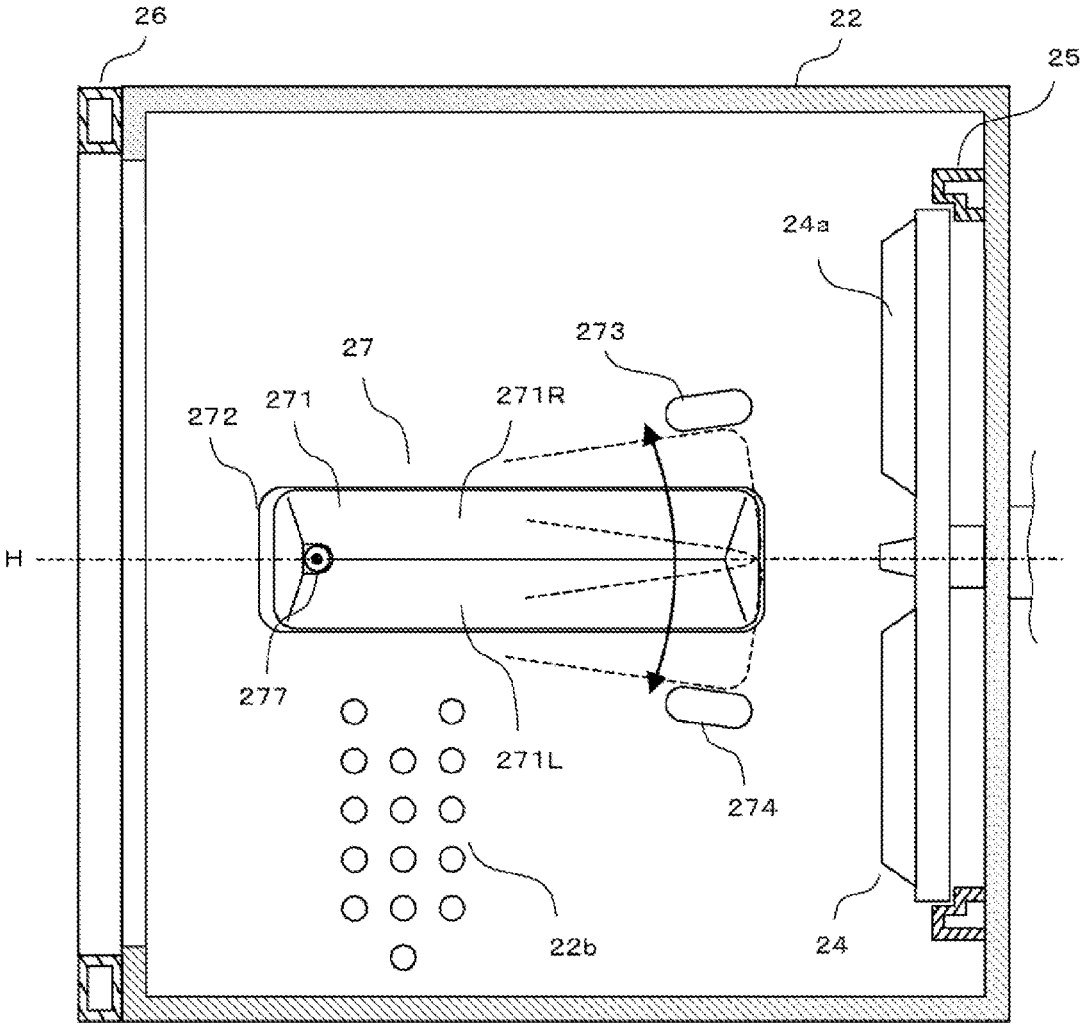
FIG. 9 is a sectional view illustrating a structure of a drum of modification I.
Figure 10:
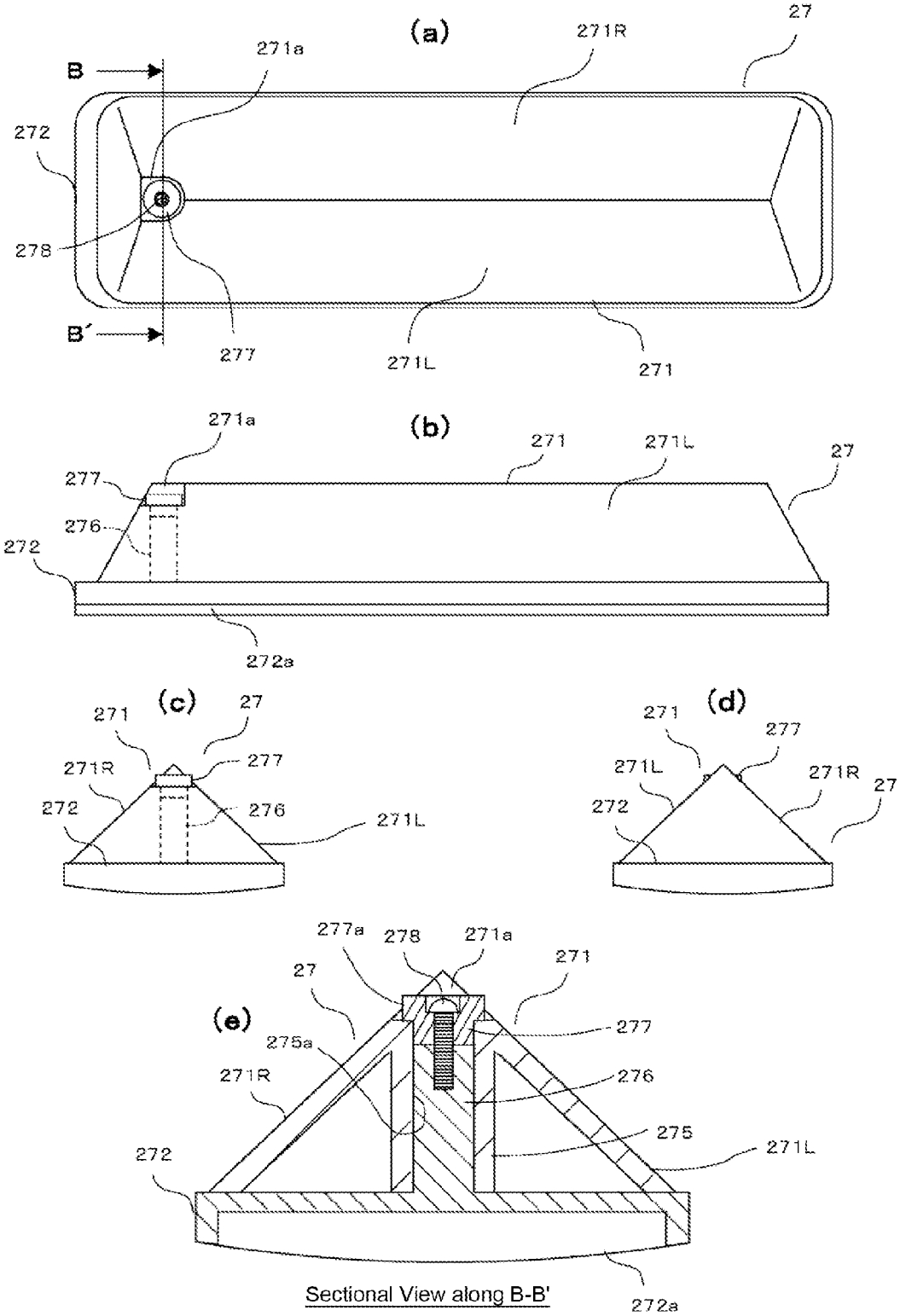
FIGS. 10(*a*)~(*e*) are diagrams illustrating a structure of a baffle unit of modification I.

FIG. 9 is a sectional view illustrating the structure of the drum 22 of the modification I. FIG. 10 is a diagram illustrating the structure of a baffle unit 27 of the modification I. FIGS. 10(*a*), (*b*), (*c*) and (*d*) are a top view, a right view, a front view and a rear view of the baffle unit 27 respectively. FIG. 10(*e*) is a sectional view along B-B' of FIG. 10(*a*).

In the present modification, instead of the baffles 23, baffle units 27 are arranged on the inner circumferential surface of the drum 22. Although only one baffle unit 27 is shown in FIG. 9, three baffle units 27 are arranged in the drum 22 like the above embodiment. It should be noted that the baffle units 27 are not limited to three as long as at least one baffle unit is arranged in the drum 22.

With reference to FIG. 9 and FIG. 10, the baffle unit 27 includes a baffle 271, a base body 272, a right displacement restrictor 273 and a left displacement restrictor 274.

The baffle 271 is a hollow body having an approximate triangular shape viewed from the front, an approximate trapezoidal shape viewed from the side, and a bottom surface of which is opened. The baffle 271 includes: an approximate trapezoidal right gathering surface 271R for gathering the washings when the drum 22 is rotated to the right; and an approximate trapezoidal left gathering surface 271L for gathering the washings when the drum 22 is rotated to the left. Further, a bearing sleeve 275 is formed in a front end of the baffle 271, and a recess 271*a* is formed in an outer part side. A shaft hole 275*a* formed in the bearing sleeve 275 penetrates into the bottom surface of the recess 271*a*.

The base body 272 is in an approximate rectangular shape as viewed from the top. The size of an upper surface of the base body 272 is slightly greater than the size of the bottom surface of the baffle 271. A rotating shaft 276 is formed in the base body 272, and the rotating shaft 276 is inserted into the shaft hole 275*a* of the bearing sleeve 275 so that the front end of the baffle 271 is rotatablely supported on the base body 272. An anti-dropping member 277, which drops from the side of the recess 271*a*, is mounted at the upper end of the rotating shaft 276 through a screw 278. Since a diameter of a head part 277*a* of the anti-dropping member 277 is greater than a diameter of the shaft hole 275*a*, the bearing sleeve 275 of the baffle 271 will not drop from the rotating shaft 276. As shown in FIG. 9, the base body 272 equipped with the baffle 271 is fixed on the inner circumferential surface of the drum 22 by a fixing method such as the screw, with the base body being parallel to the horizontal axis H.

The right displacement restrictor 273 is arranged on the inner circumferential surface of the drum 22 at a position where the rear part of the baffle 271 is touched when the baffle 271 is inclined for a predetermined angle from being parallel to the horizontal axis H in the right rotation direction of the drum 22. The left displacement restrictor 274 is arranged on the inner circumferential surface of the drum 22 at a position where the rear part of the baffle 271 is touched when the baffle 271 is inclined for a predetermined angle from being parallel to the horizontal axis H in the left rotation direction of the drum 22. The predetermined angle may be an angle of several degrees to tens of degrees.

The distance between the bottom surface of the baffle 271 and the inner circumferential surface of the drum 22 is about a height of the base body 272. Therefore, when the baffle 271 is inclined to both sides, the bottom surface of the baffle 271 will not touch the inner circumferential surface of the drum 22 until the left displacement restrictor 273 and the right displacement restrictor 274 are touched. It should be noted that the height of the base body 272 can also be adjusted so that the bottom surface of the baffle 271 touches the inner circumferential surface of the drum 22 and cannot be further inclined when the baffle 271 is inclined for the predetermined angle from being parallel to the horizontal axis H. In this case, the left displacement restrictor 273 and the right displacement restrictor 274 may be omitted.

Figure 11:
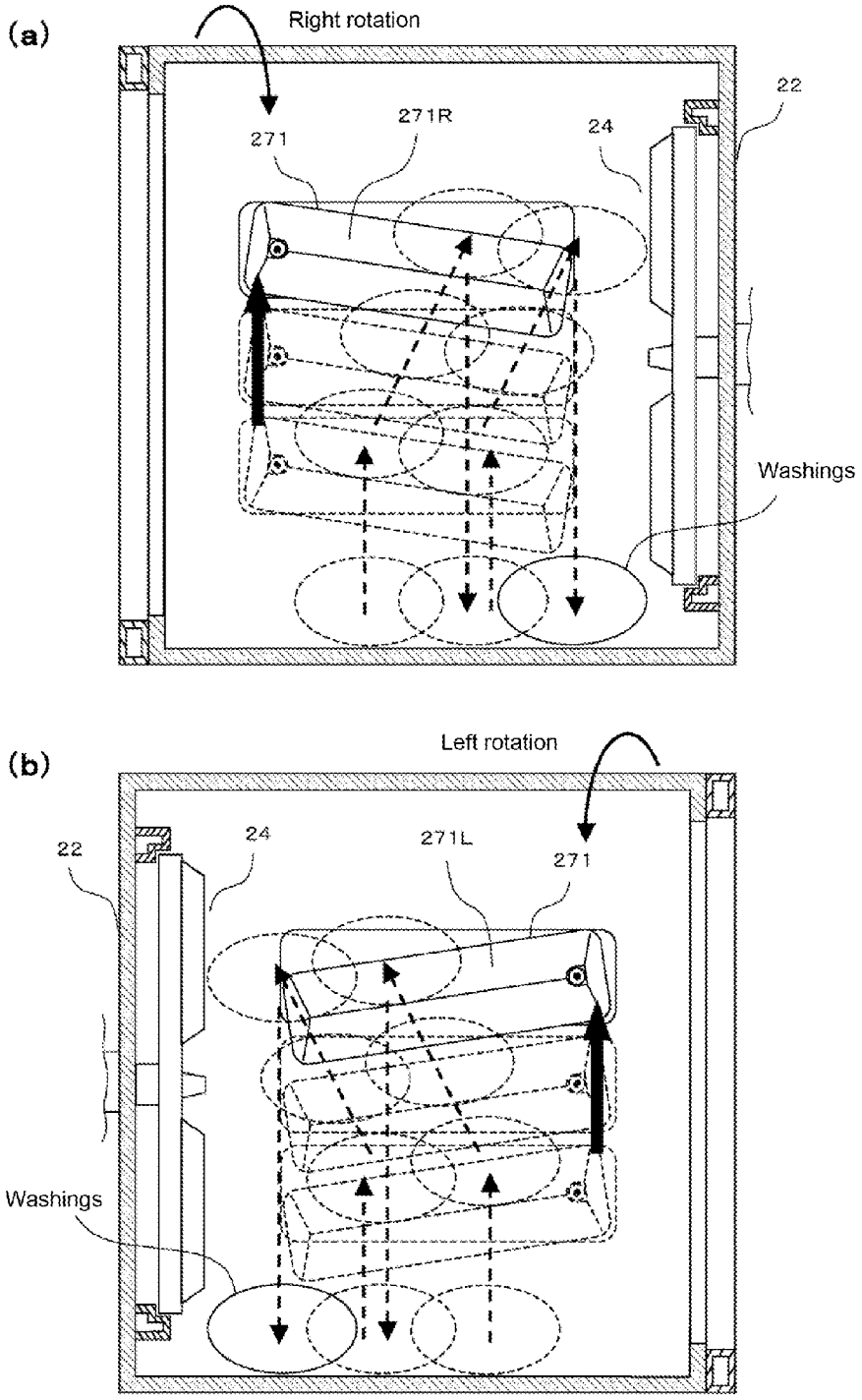
FIGS. 11(*a*)~(*b*) are diagrams schematically illustrating a tendency of washings that are rolled through baffles during a washing or rinsing process in modification I.

FIG. 11 is a diagram schematically illustrating the tendency of the washings when being rolled by the baffle 271 during the washing or rinsing process. FIG. 11(*a*) schematically illustrates the tendency of the washings when the drum 22 is rotated to the right; and FIG. 11(*b*) schematically illustrates the tendency of the washings when the drum 22 is rotated to the left.

When the drum 22 rotates to the right, the washings are gathered by the right gathering surface 271R. Meanwhile, the baffle 271 is inclined to the left rotation direction of the drum 22 due to the weight of the washings, and a side adjacent to the rotating body 24 of the right gathering surface 271R becomes lower. Therefore, the washings gathered by the right gathering surface 271R are moved to the side of the rotating body 24 along the right gathering surface 271R. On the other hand, when the drum 22 rotates to the left, the washings are gathered by the left gathering surface 271L. Meanwhile, the baffle 271 is inclined to the right rotation direction of the drum 22 due to the weight of the washings, and a side adjacent to the rotation body 24 of the left gathering surface 271L becomes lower. Therefore, the washings gathered by the left gathering surface 271L are moved to the side of the rotating body 24 along the left gathering surface 271L. In this way, even if the washings are placed at the front side of the drum 22, i.e., a position away from the rotating body 24, the washings are moved to the rear side of the drum 22, i.e., a position where the washings contact the rotating body 24, in the period of repeatedly rolling the washings through the left rotation and the right rotation of the drum 22, as shown in the dotted arrows of FIGS. 11(*a*) and (*b*).

In this way, in the present modification, the washings can be moved to the rear part of the drum 22 equipped with the rotating body 24 while being rolled through the baffles 271 constituting the moving units. Therefore, similar to the above-mentioned embodiment, the washings can be well imparted with the washing effect brought by the rotating body 24 without being affected by the amount of the washings and the like.

Further, in the present modification, the right gathering surface 271R and the left gathering surface 271L can automatically incline according to the rotation direction of the drum 22, thus the shapes of the right gathering surface 271R and the left gathering surface 271L may not be set as the triangular shape as described in the above-mentioned embodiment, but may be set as a quadrilateral shape such as a trapezoidal shape. As a result, areas of the right gathering surface 271R and the left gathering surface 271L can be increased, so that the washings can be rolled well through the baffles 271.

<Modification II>

Figure 12:
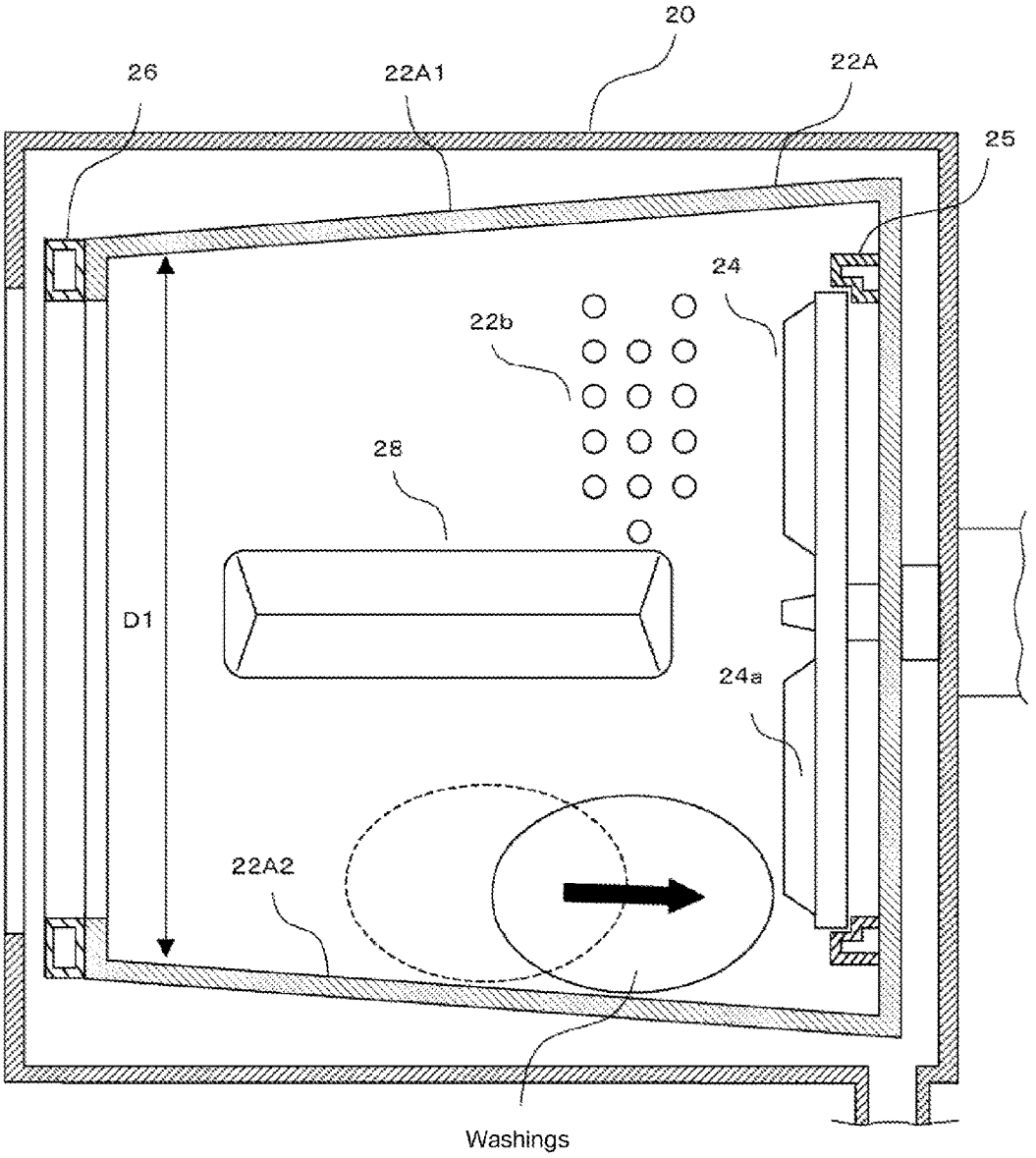
FIG. 12 is a sectional view illustrating a structure of a drum of modification II.

FIG. 12 is a sectional view illustrating a structure of a drum 22A of the modification II.

In the present modification, a drum 22A is configured in the outer tank 20 for replacing the drum 22. The drum 22A is formed in such a manner that an inner diameter of a peripheral wall 22A1, i.e., a diameter D1 of an inner circumferential surface 22A2, gradually increases toward the rear. As a result, the inner circumferential surface 22A2 of the drum 22A is inclined downward on the bottom side of the outer tank 20.

Three baffles 28 are arranged on the inner circumferential surface 22A2 of the drum 22A in the circumferential direction at substantively equal intervals. FIG. 12 shows only one baffle 28. The baffle 28 has the same structure as that of the baffle 271 of modification I, except that the baffle 28 is directly fixed on the drum 22 rather than being supported by the base body 272.

When the drum 22A is rotated to the left and the right, the washings are rolled by the baffles 28. When being fallen onto the inner circumferential surface 22A2 of the drum 22A, the rolled washings move backward along a downward slope of the inner circumferential surface 22A2. In this way, the washings can be easily moved towards the rear part of the drum 22A during a process of rolling, and contact the rotating body 24.

In the present modification, the moving unit has an inclination on the inner circumferential surface 22A2 of the drum 22A in such a manner that the diameter becomes larger gradually when approaching the rear of the drum, thus the rolled washings can be moved towards the rear part of the drum 22A, and the washings can be well imparted with the washing effect brought by the rotating body 24.

Further, in the present modification, the moving unit, which has an inclination on the inner circumferential surface 22A2 of the drum 22A in such a manner that the diameter becomes larger gradually when approaching the rear of the drum and can move the washings to the side of the rotating body 24, can be realized easily.

It should be noted that, in the present modification, the baffles 28 can be replaced with the baffles 23 or the baffle units 27. In this way, the washings can move to the side of the rotating body 24 more easily.

<Other Modifications>

Embodiments of the present disclosure can also be subjected to various changes, besides the above-mentioned modifications.

For example, in the modification II, the peripheral wall 22A1 of the drum 22A has an inclination. However, the drum 22A can also be replaced with the drum 22B shown in FIG. 13.

Figure 13:
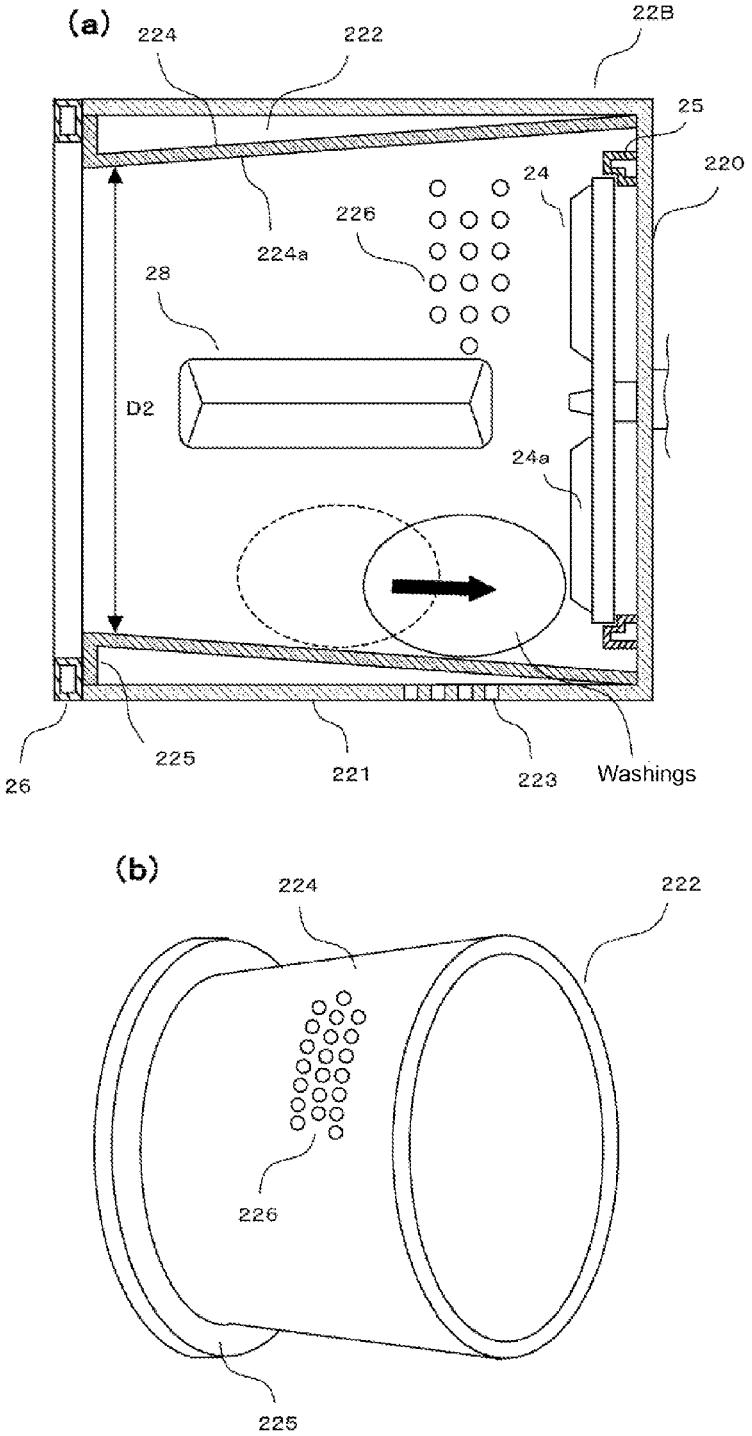
FIGS. 13(*a*)~(*b*) are sectional views illustrating a structure of a drum of other modifications.

FIG. 13(*a*) is a sectional view illustrating the structure of the drum 22B, and FIG. 13(*b*) is a perspective diagram of an inner member 222 as viewed from the rear.

The drum 22B is formed by accommodating the inner member 222 inside a drum body 220, in which the peripheral wall 221 of the drum body 220 is not inclined, while the inner member 222 has an inner circumferential surface 224*a* with an inclination.

A plurality of spin-drying holes 223 are formed substantively throughout the whole surface of the peripheral wall 221 of the drum body 220. In addition, the drum body 220 can be opened from the entire front surface in such a manner that the inner member 222 can be accommodated from the front.

The inner member 222 includes: a body part 224; and an annular flange part 225 formed at the front end of the body part 224. The body part 224 is formed in such a manner that a diameter D2 of the inner circumferential surface 224*a* becomes larger gradually when approaching the rear. A plurality of spin-drying holes 226 are formed substantively throughout the entire surface of the body part 224. When an outer diameter of the flange part 225 is the same as that of the rear end of the body part 224 and the inner member 222 is accommodated in the drum body 220, an outer circumferential surface of the flange part 225 and the outer circumferential surface of the rear end of the body part 224 are abutted against the inner circumferential surface of the drum body 220.

In this way, similar to modification II, in the case of using the drum 22B, since the rolled washings can move towards the rear part of the drum 22B due to a downward inclination of the inner circumferential surface 224*a* of the body part 224, the washings can also be well imparted with the washing effect brought by the rotating body 24.

Further, in the above-mentioned embodiment, the right gathering surface 23R and the left gathering surface 23L of the baffles 23 are formed as flat surfaces. However, the right gathering surface 23R and the left gathering surface 23L are not limited to flat surfaces, and can also be, e.g., convex curved surfaces or concave curved surfaces. Similarly, the right gathering surfaces 271R and the left gathering surfaces 271L of the baffles 271 of the modification I are not limited to flat surfaces, and can also be, e.g., convex curved surfaces or concave curved surfaces.

Further, although the drum washing machine 1 in the above embodiment does not have a drying function, the present invention also can be applied to a drum washing machine with the drying function, that is, a drum washing and drying machine.

In addition, embodiments of the present disclosure can be subjected to various changes within the scope of a technical idea shown in claims.

LIST OF REFERENCE NUMERALS

10: housing; 20: outer tank; 22: drum; 23: baffle; 23R: right gathering surface; 23L: left gathering surface; 24: rotating body; 24*a*: projection; 27: baffle unit; 271: baffle; 272: base body; 276: rotating shaft; 22A: drum; 22A2: inner circumferential surface; 22B: drum; 220: drum body; 222: inner member; 224: body part; and 224*a*: inner circumferential surface.

What is claimed is:

1. A drum washing machine, comprising:

an outer tank arranged in a housing;

a drum, which is arranged in the outer tank and capable of rotating about a horizontal axis;

a rotating body, which is arranged at a rear part of the drum, and a surface of the rotating body being provided with a projection; and a driving part, configured to drive the drum and the rotating body to coaxially rotate at different rotating speeds;

wherein the drum comprises a moving unit configured to move the washings in the drum towards the rotating body;

wherein the moving unit comprises a baffle which is arranged on an inner circumferential surface of the drum and which is operative to rotate about a rotating shaft disposed on an end part opposite to the side of the rotating body, enabling the baffle to incline to two sides from being parallel to the horizontal axis.

2. The drum washing machine according to claim 1, wherein the moving unit comprises the baffle, which is arranged on the inner circumferential surface of the drum and has gathering surfaces for gathering the washings through a rotation of the drum, wherein the gathering surfaces are inclined so that the side of the rotating body is lagged in a rotation direction of the drum.

3. The drum washing machine according to claim 2, wherein the inner circumferential surface of the drum is inclined so that a diameter of the inner circumferential surface becomes larger when approaching the rear part of the drum.

4. The drum washing machine according to claim 2, wherein the baffle has two gathering surfaces which respectively correspond to a right rotation and a left rotation of the drum.

5. The drum washing machine according to claim 4, wherein the inner circumferential surface of the drum is inclined so that a diameter of the inner circumferential surface becomes larger when approaching the rear part of the drum.

6. The drum washing machine according to claim 1, wherein the moving unit comprises the inner circumferential surface of the drum, wherein the inner circumferential surface of the drum is inclined so that a diameter of the inner circumferential surface becomes larger when approaching the rear part of the drum.

7. The drum washing machine according to claim 1, wherein the inner circumferential surface of the drum is inclined so that a diameter of the inner circumferential surface becomes larger when approaching the rear part of the drum.

* * * * *